United States Patent [19]

Wisniewski

[11] 4,384,742

[45] May 24, 1983

[54] HEIGHT ADJUSTING MECHANISM FOR CHAIR BACK

[75] Inventor: Joseph M. Wisniewski, Marne, Mich.

[73] Assignee: Haworth, Inc., Holland, Mich.

[21] Appl. No.: 242,804

[22] Filed: Mar. 11, 1981

[51] Int. Cl.[3] ..... A47C 1/00

[52] U.S. Cl. ..... 297/353; 248/408; 403/107; 403/325

[58] Field of Search ..... 297/353, 410; 108/146; 248/407–409, 423, 188.5; 292/267, 274, 278; 403/106, 107, 109, 322, 325

[56] References Cited

U.S. PATENT DOCUMENTS

| | | | |
|---|---|---|---|
| 3,802,658 | 4/1974 | Binding | 248/423 X |
| 4,012,158 | 3/1977 | Harper | 297/353 X |
| 4,036,525 | 7/1977 | Howk | 297/353 |
| 4,043,592 | 8/1977 | Fries | 297/354 X |
| 4,221,430 | 9/1980 | Frobose | 297/410 X |

*Primary Examiner*—William E. Lyddane

*Attorney, Agent, or Firm*—Flynn, Thiel, Boutell & Tanis

[57] ABSTRACT

An adjustable mechanism for use with an office chair, such as a secretarial chair, to allow vertical adjustment of the seat back. The mechanism includes a slide which is mounted on the chair back and is vertically slidably supported on an upright which projects from the seat portion of the chair. The slide has a latching lever pivotally mounted thereon and spring-urged into engagement with one of a series of notches formed along one side of an elongated slot formed in the upright. The notches, together with the latching projection formed on the lever, are defined by upper and lower edge surfaces which are individually generated about a centerpoint which is coincident with the pivot axis of the lever to maintain the chair back securely latched when either upward or downward external forces are imposed thereon.

5 Claims, 6 Drawing Figures

HEIGHT ADJUSTING MECHANISM FOR CHAIR BACK

FIELD OF THE INVENTION

This invention relates to an improved height adjusting mechanism for permitting the back of a chair, such as a secretarial chair, to be selectively vertically adjusted, while at the same time providing a secure latching of the chair back to prevent accidental release of same due to upward or downward external forces being imposed thereon.

BACKGROUND OF THE INVENTION

Commercial or office chairs, and specifically those commonly referred to as secretarial chairs, are generally provided with an adjustment structure for permitting the vertical position of the back to be adjusted to accommodate the user. In the past, many chairs employed a threaded handle arrangement mounted on the chair back and creating a frictional engagement with an upright for vertically adjusting but fixedly securing the chair back. These threaded handle arrangements have been extensively utilized, but have been recognized as being not only unreliable, but more importantly extremely unsightly in view of their protrusion from the rear of the chair back.

Accordingly, in recent years manufacturers have attempted to provide height adjusting mechanisms which are more effectively hidden within the interior of the chair back. Most of these mechanisms, however, have been bulky and/or structurally and mechanically complex. More importantly, most of these mechanisms have been unable to provide secure latching of the chair back to the upright, particularly when the chair back is subjected to an external vertical load, and hence have permitted the chair back to be released permitting undesired vertical displacement of the chair back either upwardly or downwardly. For example, a person standing adjacent a chair may lean against the chair back and hence impose a rather substantial downward force thereon, which force often causes release of the adjusting mechanism, whereupon the chair back moves suddenly downwardly, and hence creates a situation which can cause possible harm to the person or at the least annoyance and inconvenience. Similarly, it has also been discovered that many of the adjusting mechanisms permit the chair back to be released when the chair is lifted upwardly by the back, and again this causes annoyance and inconvenience, and also creates a situation where possible injury can occur.

In recognition of the above problem, and specifically the safety hazard created when the chair back releases upon application of a downwardly-directed external force, the association representing manufacturers of office furniture have required that all chairs employing a vertically adjustable back must be capable of withstanding a downward external load on the back of at least 300 pounds without permitting release of the back. Many known adjusting mechanisms are unable to withstand such load, and while others are capable of withstanding this load, nevertheless even these others are generally of substantial complexity and/or require excessive spring forces which make manual release of the mechanisms extremely difficult. Thus, these known mechanisms are still considered deficient in many respects.

One attempt to provide an improved height-adjusting mechanism is illustrated by U.S. Pat. No. 4,012,158 issued to Harper. The adjusting mechanism disclosed in this patent employs a latching lever pivotally mounted on a support secured to the chair back, which latching lever is spring-urged so that a small tooth thereon is selectively engageable with one of a plurality of notches formed along the outer edge of the upright. These notches slope downwardly as they project toward the outer edge of the upright, and are provided with straight sidewalls. While this known mechanism is desirable in view of its compact and simple structure, nevertheless it has been observed that forming the mechanism with straight-sided notches employing a lever and notch arrangement having the positional arrangement disclosed in this patent is unsatisfactory, since this type mechanism is believed to permit the latching lever to automatically disengage from the notch when an external downward force of substantial magnitude is imposed on the chair back. In addition, the latching finger associated with the lever is extremely small and undersized relative to the notches, so that substantial vertical looseness exists between the latching finger and the notches. This is also undesirable when an upward external force is imposed on the chair back, such as the chair being lifted by the back, since this results in at least a small upward movement of the back so that the finger impacts against the upper sidewall of the notch, and this can cause accidental release of the latching finger and hence release of the chair back.

Accordingly, this invention relates to an improved height-adjusting mechanism for a chair back, which mechanism overcomes the aforementioned disadvantages.

More specifically, the improved height-adjusting mechanism of this invention is desirably simple and compact, and can be effectively hidden within the interior of the chair back so as to not detract from the appearance thereof. At the same time, this improved mechanism permits the chair back to be securely latched or locked in any one of a selected number of discrete vertical positions, with the mechanism maintaining the chair back securely locked even when a substantial upward or downward external load (such as at least 300 pounds) is imposed on the chair back.

The adjusting mechanism of this invention coacts with, and in fact includes part of, the upright which projects upwardly from the chair seat. The upright has an elongated slot extending vertically thereof, and a slide member mounted on the chair back is slidably accommodated within the slot. One of the inner edges of the slot has a series of vertically spaced notches formed therein, which notches open into the slot. An adjustment lever is pivotally mounted on the slide for swinging movement about a substantially horizontal axis, and is spring-urged toward a position of engagement with one of the notches. The latching lever has, at its upper end, a sidewardly-projecting finger for engagement within one of the notches. This latching finger, and each of the notches, is defined by opposed upper and lower edges which are generated on radii which are centered on the pivot axis of the lever, and the finger is sized to snugly fit within and substantially totally fill the notch, whereby imposition of upward or downward external forces on the chair back causes these forces to be resisted over a substantial peripheral area between the latching finger and the notch, which resisting forces are directed radially relative to the pivot axis. This enables the latching lever to be securely maintained in its latched position, even when upward or downward external forces of substantial magnitude are imposed on the chair back.

Other objects and purposes of the invention will be apparent to persons familiar with structures of this type upon reading the following specification and inspecting the accompanying drawings.

Figure 2:
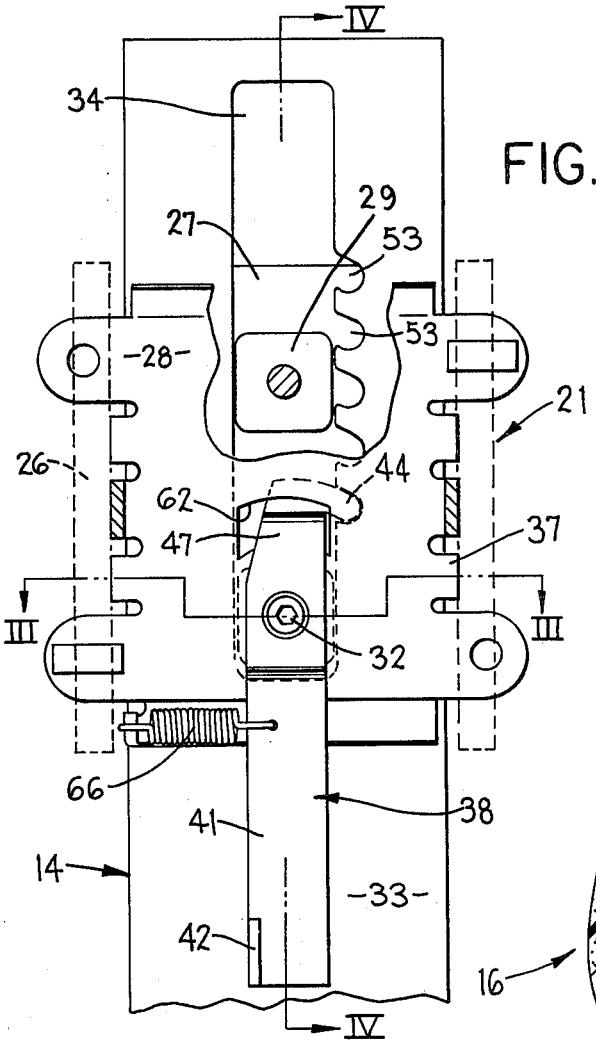
FIG. 2 is an enlarged fragmentary view of the height-adjusting mechanism, substantially as taken along line II—II in FIG. 1.

Certain terminology will be used in the following description for convenience in reference only, and will not be limiting. For example, the words "upwardly," "downwardly," "leftwardly" and "rightwardly" will refer to directions in the drawings to which reference is made. The words "upwardly " and "downwardly" will also have reference to the direction of movement of the chair back relative to the upright. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

Figure 1:
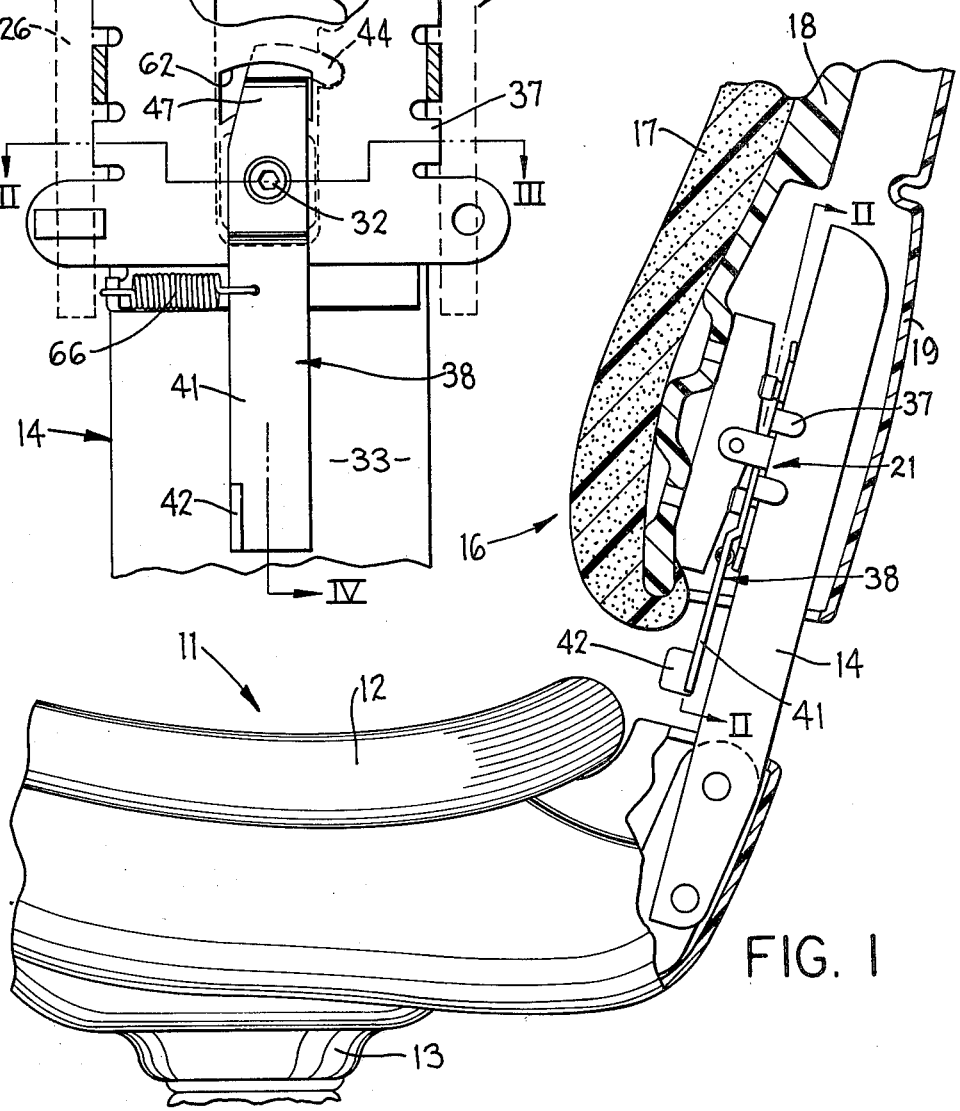
FIG. 1 is a fragmentary elevational view, partially in cross-section, of a chair incorporating therein the inventive height-adjusting mechanism.
Figure 3:
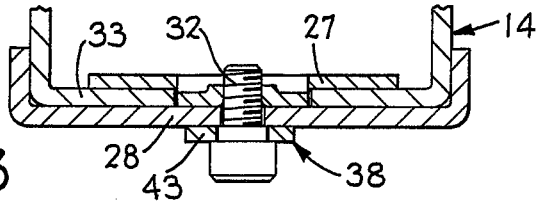
FIG. 3 is a sectional view taken along line III—III in FIG. 2.

FIG. 1 illustrates a chair 11 having a seat portion 12 supported in the conventional manner by a pedestal or leg structure 13. An upright 14 is connected to the rear of the seat 12 and projects upwardly therefrom. A conventional seat back 16 is connected to and supported by the upright 14. This seat back 16, in the illustrated embodiment, includes an exterior cushion 17 which overlies an inner support shell 18, the latter being spaced from but suitably joined to a rear support shell 19. These shells 18 and 19 define therein an interior region into which projects the upright 14, and the improved height-adjusting mechanism 21 is provided for joining the chair back 16 to the upright 14.

The height-adjusting mechanism 21, as illustrated by FIGS. 2–5, includes a slide 22 which defines thereon a pair of forwardly-projecting tabs 23 which, through pivots 24, are joined to suitable supports 26, the latter being secured to the inner shell 18. This arrangement enables the chair back 16 to be tiltable about the pivot 24, such as is conventional with secretarial chairs, although it will be appreciated that the chair back can be fixed if desired, in which case the slide 22 would be fixedly related to the inner shell 18.

The slide 22 includes a pair of relatively flat but thin plate members 27 and 28 disposed in opposed but slightly spaced relationship. The plate member 27 has a pair of blocklike offset portions 29 formed therein, which offset portions are seated against the plate 28 so that the major portion of the plates 27–28 are maintained in parallel but spaced relationship. Suitable screws 31 and 32 are provided for rigidly joining the plates 27–28 together.

Figure 5:
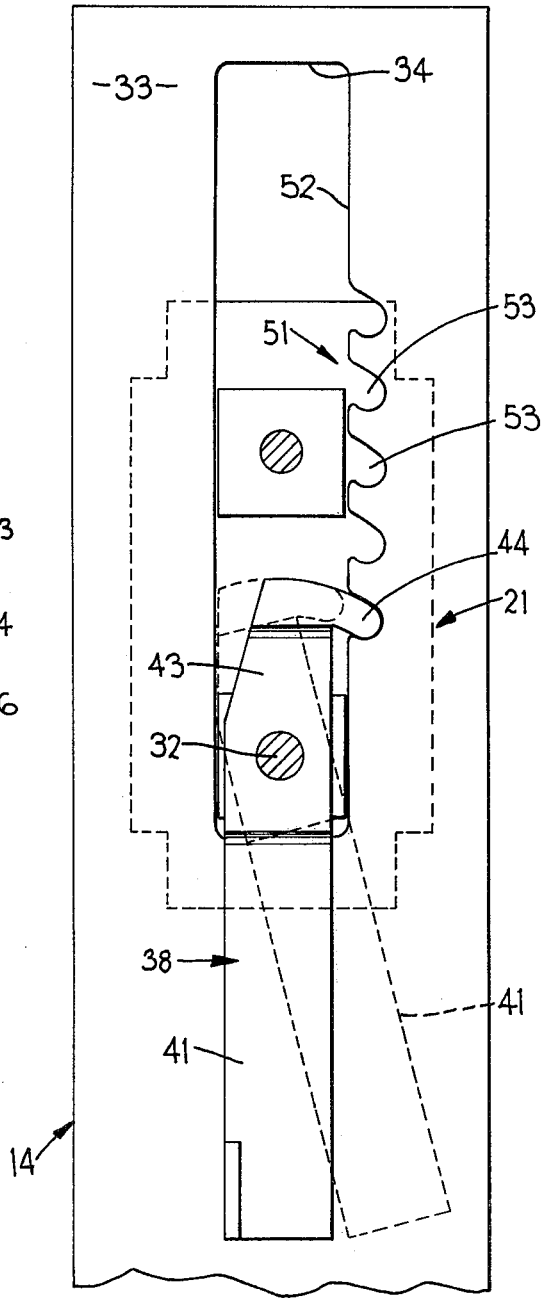
FIG. 5 is a fragmentary sectional view taken along line V—V in FIG. 4.

The slide 22 is positioned directly adjacent and vertically slidably supported on the upright 14. This upright 14, in the illustrated embodiment, comprises an elongated rearwardly-opening U-shaped channel having a base web 33 provided with an elongated narrow slot 34 extending longitudinally thereof. This slot 34 is positioned centrally of web 33 and has a width which is relatively narrow relative to the overall width of the web. The offset portions 29 associated with slide 22 are sized so that they snugly but slidably fit within the slot 34, substantially as illustrated by FIG. 5, whereby the individual slide plates 27–28 are thus disposed substantially coplanar with but on opposite sides of the web 33. To facilitate displacement of slide 22 vertically (that is longitudinally) along the upright 14, the upper and lower ends 36 of plates 27–28 are preferably tapered slightly outwardly. The slide plate 28, which is disposed adjacent the outer side of web 33, is also provided with tabs or flanges 37 on opposite sides thereof, which flanges are bent inwardly at right angles and hence slidably embrace the upright 14 therebetween.

The height-adjusting mechanism 16 includes an adjustment or latching lever 38 hingedly supported on the slide 22. This lever 38, in the illustrated embodiment, is hingedly supported on the lower screw 32 and hence is pivotally swingable about a hinge axis 39 defined by this screw. The lever 38 is formed from a thin platelike element and includes an elongated handle 41 which is positioned adjacent the front or outer side of the channel web and projects downwardly from the hinge axis 39, which handle 41 preferably projects downwardly so that the lower end thereof projects slightly below the cushion 17. The lower exposed end of handle 41 preferably has a finger-engaging tab 42 thereon so that the lever can be suitably manually actuated, while at the same time the lever is positioned so as to be virtually hidden and hence not detract from the overall appearance of the chair.

Figure 6:
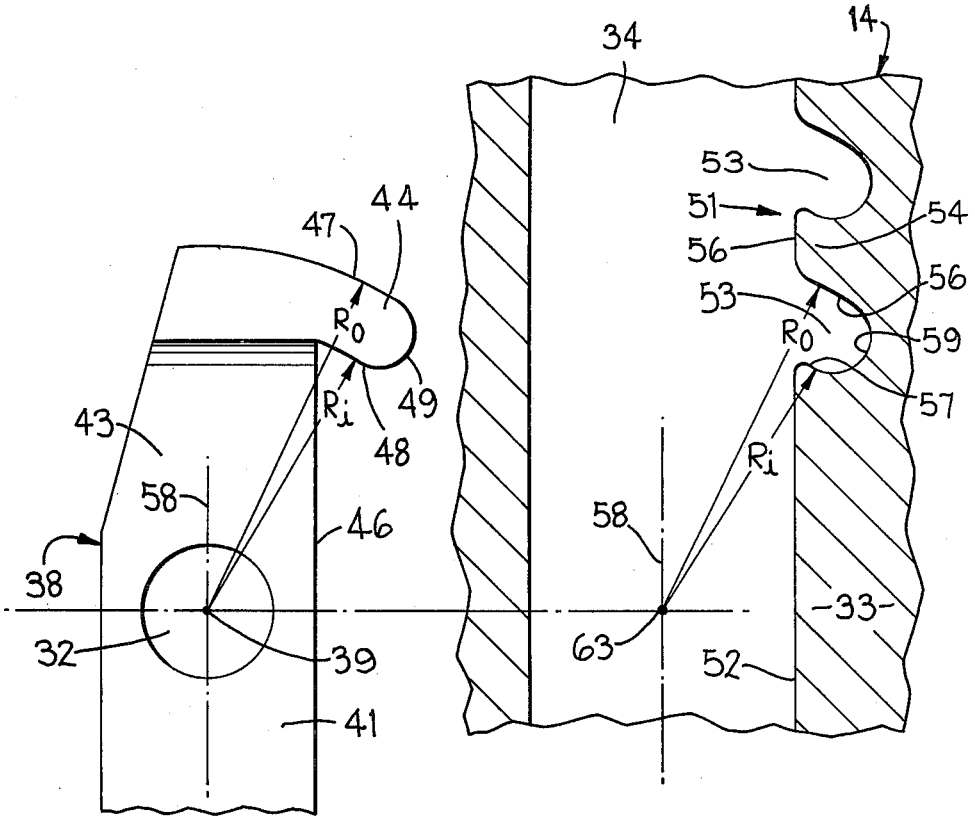
FIG. 6 illustrates the configuration of the latching lever and the related notches provided in the upright.

The adjustment lever 38 has a latching or locking portion 43 which projects inwardly from the hinge axis 39 and, at its upper free end, is provided with a latching finger or projection 44 which extends sidewardly a substantial distance beyond the adjacent side edge 46 of the lever. This latching finger 44, as most clearly illustrated in FIG. 6, is defined by upper and lower side edges 47 and 48, respectively, each of which is formed as a partial cylindrical surface generated about a common center defined by the pivot axis 39. That is, the outer edge 47 is cylindrical, being formed on a radius $R_o$ generated about the pivot axis 39, with the inner edge 48 being formed on a radius $R_i$ generated about the same axis 39. The latching finger 44 also terminates in a rounded outer edge or nose 49, which preferably comprises a substantially semi-cylindrical surface which extends between and merges smoothly with the side edges 47 and 48.

The latching finger 44 is designed for cooperation with a toothed rack 51 which is fixedly associated with, and in fact is integrally formed on, the upright 14. This toothed rack 51 is directly associated with the web 33 and is disposed directly along the side edge 52 of slot 34. The rack 51 includes a plurality of identical notches or recesses 53 which are vertically spaced from one another and which individually communicate directly with the slot 34 and open into the web 33 through the side edge 52. These notches 53 are separated by intermediate enlarged portions 54 which resemble teeth, which portions have the free end surfaces 56 thereof being part of the side edge 52.

As illustrated by FIG. 6, each notch 53 is sized so as to snugly accommodate therein the latching finger 44. For this reason, the notch 53 is defined by upper and lower edges 56 and 57, respectively, which open outwardly through the slot side edge 52, with the notch edges 56 and 57 being joined by a rounded bottom wall 59 of substantially semi-cylindrical configuration which merges smoothly with the edges 56 and 57. The upper edge 56 is of a partial cylindrical configuration, and in fact is formed by being generated on a radius $R_o$ about a center 63 which lies on a reference line 58, which line 58 extends through the longitudinal center of slot 34. The lower edge 57 also of a partial cylindrical configuration and is formed on a radius $R_i$ which is also generated about the centerpoint 63. Each of the notches 53 are formed in an identical manner and, since the radii used for generating the upper and lower edges of each notch 53 correspond with the radii used for generating the upper and lower edges of the latching finger 44, the center 63 used for generating the edges of the respective notch 53 is hence aligned with the pivot axis 33 when the lever 38 is disposed so that its latching finger 44 projects into the respective notch. Of course, a minimal clearance is provided between the edges of the notch and the edges of the latching finger, but this clearance is normally in the order of several one-thousandths of an inch, and hence for all practical purposes the radii used for generating the notch and latching finger are identical.

Figure 4:
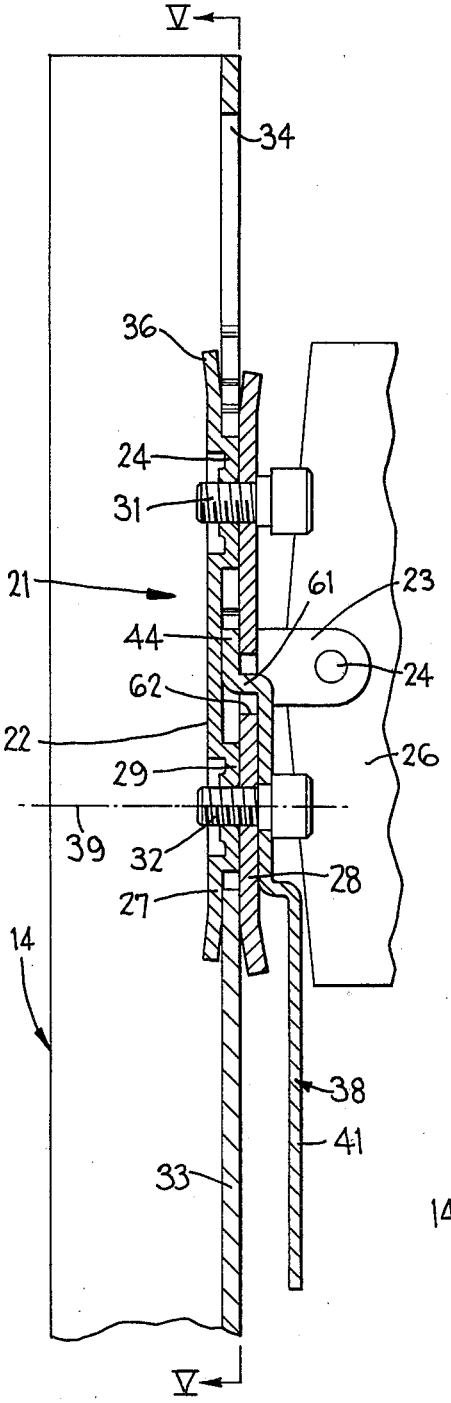
FIG. 4 is a fragmentary sectional view taken along line IV—IV in FIG. 2.

As illustrated by FIG. 4, the upper latching portion 43 of the lever 38 is provided with a transverse offset 61 therein which results in this latching portion 47 having a substantially Z-shaped configuration. The offset 61 extends through an opening 62 formed in the slide plate 28, whereby the free end part of the lever, namely that part having the latching finger 44 thereon, is hence slidably enclosed between the plates 27 and 28, whereby the latching finger 44 is thus closely sidewardly confined and hence can be swingably moved into engagement with the respective notch 53. The finger 44 is thus positively sidewardly retained within the notch so that a sideward disengagement between the notch and the latching finger is effectively prevented.

The height-adjusting mechanism is also provided with a low-force tension spring 64, one end of which is anchored to the handle 41, and the other end of which is anchored to a tab provided on the slide plate 28. This spring 64 continuously urges the lever 38 toward a latched position, that is, the lever is always urged clockwise in FIGS. 2 and 5 so that the latching finger 44 is urged into one of the notches 53.

OPERATION

During normal utilization of the chair, the back 16 is securely latched to the upright 14 in the desired adjusted vertical position due to the latching finger 44 associated with lever 38 being maintained in latching engagement within a selected one of notches 53. The latching lever is continuously urged into this latched position due to urging of spring 64. When adjustment in the height of chair back 16 is desired, the operator can manually engage the handle 41 and easily pivot same counterclockwise in FIG. 5 against the urging of spring 46, thereby releasing the lever as indicated by the dotted position in FIG. 5. The chair back can then be manually slid upwardly or downwardly along the upright 14, which slidable movement is accomplished by the slide 22 being slidably displaced vertically along the upright web 33, being guided by the slot 34. When the desired vertical position of chair back 16 is reached, then the lever 38 is manually released, and the spring 64 automatically returns the latching lever into a latching position wherein the finger 44 projects into the selected notch 53. In the event that finger 44 is not initially aligned with one of the notches, then the nose of finger 44 will bear against the free tooth edge 56 until the chair back is slightly displaced a small vertical extent, whereupon the spring then causes the finger 44 to automatically enter into and engage the adjacent notch 53.

Once the latching finger 44 is engaged within the respective notch 53, the chair back is fixedly and securely latched to the upright 14. Further, this latched relationship is maintained even though a substantial external force, whether directed upwardly or downwardly, is imposed on the chair back 16. This secure latching of the chair back on the upright is achieved due to the configuration of the latching finger 44 and the mating or corresponding configuration of the notches 53, coupled with the positional relationship of the notches 53 along the adjacent side edge 52 of the slot. More specifically, since the upper and lower edges 47–48 and 56–57 associated with the latching finger 44 and notch 53 are formed as partial cylindrical surfaces which are generated about substantially the same radii $R_o$ and $R_i$ which are generated about a common centerpoint which also defines the pivot axis 39, any upwardly or downwardly directed external force imposed on the chair back 16 is thus resisted due to the engagement between either the upper or lower edge 47–48 of finger 44 bearing against the respective upper or lower edge 56–57 associated with the notch 53. Since these edges are generated about the pivot axis 39, the resistance or reaction force between the upright 14 and finger 44 is thus generated over a substantial area, and the reaction force is also directed predominantly along a line of action which projects radially through the pivot axis 39, and hence has little tendency for causing the latching lever 38 to swing away from its latched position. The latching lever is hence able to remain in this latched position even though upwardly or downwardly directed external forces of substantial magnitude are imposed on the chair back 16. Further, this desirable reaction between the upright and the latching lever operates effectively for both upwardly and downwardly directed external forces, and also enables the spring 64 to be of minimal size and force since it is no longer necessary to rely on the spring for creating the dominant torque required for maintaining the latching lever in its latched position. The spring force can hence be greatly minimized, which thus simplifies manual adjustment of the chair back.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a height-adjusting mechanism for a chair back, including an elongated upright connectible to a chair seat and projecting upwardly therefrom, said upright having a series of vertically-spaced notches associated therewith, a support connectible to the chair back and being slidably supported on the upright for vertical displacement therealong, and a spring-urged latching lever pivotally mounted on said support and being spring-urged into engagement with one of said notches for vertically fixing the support relative to the upright, the improvement wherein: said upright is of a channel-like shape and includes a plate-like base web having a vertically elongated slot extending therethrough, said slot being relatively narrow and bounded by opposed side edges defined on said base web, said series of notches being formed in said base web along one of the opposed edges which bounds said elongated slot so that said notches communicate directly with and open sidewardly from said slot; said latching lever being positioned directly adjacent said base web and mounted on said support for pivotal movement about a pivot axis which extends substantially perpendicular to said base web and intersects said slot, said latching lever having a sidewardly-projecting latching finger formed thereon in radially-spaced relationship from said pivot axis, said latching finger being defined between radially outer and inner edge surfaces which are each generated by a radius centered on said pivot axis, each said notch having a size and configuration substantially identical to that of said latching finger so as to snugly accommodate the latching finger therein.

2. A mechanism according to claim 1, wherein each said notch is defined between upper and lower side edges which are formed as partial circular surfaces generated about a common center and about radii equal to the respective radii used for generating the upper and lower edge surfaces of the latching finger, the common center associated with each said notch being aligned with the pivot axis when the latching finger is engaged with the respective notch.

3. A mechanism according to claim 1, wherein the support includes first and second slide plates which are respectively slidably disposed adjacent the inner and outer surfaces of the base web, said first and second slide plates being fixedly joined together and also including guide means which is positioned within and slidably guided by said elongated slot.

4. A mechanism according to claim 3, wherein said latching lever includes a downwardly extending handle which is positioned adjacent and outwardly from the second plate, said lever having a latching portion which projects upwardly above the pivot axis and has the latching finger formed on the upper free end thereof, said latching portion being of a Z-shaped configuration and including a transverse offset portion which projects through an opening in said second plate so that the upper part of the latching portion is positioned within the slot and is slidably confined between the first and second plates.

5. A mechanism according to claim 4, wherein the second plate has transversely-bent tabs which exteriorly slidably embrace the side legs of the channel-shaped upright.

* * * * *